US006980488B2

(12) United States Patent
Schneider

(10) Patent No.: US 6,980,488 B2
(45) Date of Patent: Dec. 27, 2005

(54) DEVICE FOR WINDING AND SETTING THE TIME OF A TIMEPIECE SUCH AS A DATE-WATCH INCLUDING A DATE DISC

(75) Inventor: Mathias Schneider, Heidenau (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 314 days.

(21) Appl. No.: 10/290,540

(22) Filed: Nov. 8, 2002

(65) Prior Publication Data

US 2003/0090963 A1 May 15, 2003

(30) Foreign Application Priority Data

Nov. 13, 2001 (CH) ..... 2079/01

(51) Int. Cl.[7] ..... G04B 19/20; G04B 27/02; G04B 29/00

(52) U.S. Cl. ..... 368/37; 368/190; 368/319

(58) Field of Search ..... 368/28, 37–38, 368/77, 237, 35, 69, 185, 190, 319–321

(56) References Cited

U.S. PATENT DOCUMENTS 2,199,017 A * 4/1940 Whitehead et al. ..... 368/185
2,362,245 A * 11/1944 Cohen ..... 368/190
3,129,557 A * 4/1964 Fiechter ..... 368/185
4,974,242 A 11/1990 Vuilleumier
5,122,997 A 6/1992 Schneider et al.
5,253,227 A * 10/1993 Wong ..... 368/69
5,699,321 A * 12/1997 Vaucher ..... 368/37

FOREIGN PATENT DOCUMENTS

| | | | |
|---|---|---|---|
| CH | 351 221 A | | 12/1960 |
| CH | 351221 A | * | 12/1960 |
| CH | 352 288 A | | 2/1961 |
| CH | 352288 A | * | 2/1961 |
| FR | 1 181 584 A | | 6/1958 |
| FR | 1181584 A | * | 6/1958 |
| WO | WO 97/44715 | | 11/1997 |

OTHER PUBLICATIONS

Australian Search Report issued in corresponding Singaporean patent application SG 200206609-0 completed Feb. 28, 2003 and mailed Mar. 10, 2003.

* cited by examiner

*Primary Examiner*—Vit W. Miska
(74) *Attorney, Agent, or Firm*—Griffin & Szipl, P.C.

(57) ABSTRACT

The present invention concerns a device for winding and setting the time of a timepiece such as a date watch (1) including a date disc (14), characterized in that the device includes a crown (12) arranged in the top plane of the watch (1) parallel to the plane of the movement (18).

9 Claims, 3 Drawing Sheets

DEVICE FOR WINDING AND SETTING THE TIME OF A TIMEPIECE SUCH AS A DATE-WATCH INCLUDING A DATE DISC

FIELD OF THE INVENTION

The present invention concerns a device for winding and setting the time of a timepiece, in particular a date-watch including a date disc.

BACKGROUND OF THE INVENTION

There is known from International Patent Application No. WO/9744715 a time-setting device for a watch. This device includes a rotating bezel placed on the exterior of the case. This bezel has a contrate toothing which co-operates with a pinion carried by a control stem provided with a crown. Depending upon whether the crown is disposed in a first or in a second pulled out position, rotational movement of the bezel causes the simultaneous rotation of the control stem and allows, for example, the current time display or an alarm to be set.

The device briefly described hereinbefore allows the various functions of the watch to be more easily adjusted. In particular, one need only pull out the control stem into the desired position and then rotate the bezel in order to carry out the setting Since the rotating bezel is placed on the top of the watchcase, it is very easily accessible, which allows the person wearing said watch to carry out adjustments without removing the watch from his wrist.

This device also has the advantage of providing a watch having pure lines and shapes. Indeed, when the control stem is not in a pulled out position, its crown is embedded in the middle part of the watch, such that the middle part has a smooth and practically continuous surface, free of any protruding portions. This is of course not the case of conventional watches, whose crown generally projects from the side of the middle part.

One drawback of the type of device concerned here lies however in the fact that it occupies a considerable amount of space. Indeed, the bezel extends over the entire external periphery of the watch, which means that sufficient place has to be provided to mount it on the watch case. More often than not, this space is made available by reducing the size of the crystal and the dial, which is detrimental to the legibility of the information displayed by the watch. This problem arises very acutely when the watch has a date disc displaying the day of the month. In a usual embodiment, this date disc is formed by a ring with an inner toothing, whose external diameter is substantially equal to that of the watch movement. It is generally driven by a resilient finger piece carried by a driving wheel that is itself linked to the hour wheel. The finger piece acts once a day on a tooth of the date disc to move it by one thirty-first of a revolution.

If, because of the presence of the rotating bezel, the diameter of the date disc has to be reduced, this will affect the legibility of the figures indicating the dates affixed to the disc. In order to overcome this problem, a known solution consists in providing two date discs concentrically arranged with respect to each other. In this embodiment, the external ring carries figures indicating the units of the day of the month, whereas the figures indicating the tens of the date are affixed to the inner ring. The fact of using two rings of large diameter means that larger sized and thus more easily legible figures indicating the units and the tens of the day of the month can be added to the rings. It will be understood however that such a device is complex and thus has a higher cost price.

The object of the present invention is to overcome the aforementioned problems in addition to others by proposing a reliable and compact device particularly for setting the time of a date watch.

SUMMARY OF THE INVENTION

The present invention thus concerns a device for winding and setting the time of a timepiece such as a date watch including a date disc, characterised in that the device includes a crown arranged in the upper horizontal plane of the watch parallel to the plane of the movement.

As a result of these features, the present invention provides a winding and time-setting device to which the user can very easily have access without having to remove his watch. Moreover, the winding and time-setting device according to the invention occupies very little space, which consequently leaves sufficient space, in particular for the dial of the watch, and thus guarantees that the information displayed by the watch can be read properly. Finally, a watch fitted with the device according to the invention has pure and elegant lines insofar as there is no crown projecting from its middle part.

According to another feature of the invention, the date disc is formed by a ring with an inner toothing and whose external diameter is substantially equal to the diameter of the watchcase.

Since the device according to the invention takes up little space, the diameter, and thus the perimeter of the date-disc, can be increased, which means that larger sized and thus more easily legible figures indicating the day of the month can be affixed to the disc. Moreover, the date indicator includes a single ring, which simplifies the construction and guarantees reliable operation.

According to yet another feature of the invention, the crown and an aperture pierced in the dial of the watch through which the date of a given day of the month is visible, are arranged diametrically opposite each other on the external periphery of the watch. Consequently, the aesthetic appearance of the watch is greatly improved.

BRIEF DESCRIPTION OF THE DRAWINGS

Other features and advantages of the present invention will appear more clearly from the following detailed description of an embodiment example of the winding and time-setting device according to the invention, this example being given purely by way of non-limiting example, in conjunction with the annexed drawings, in which.

DETAILED DESCRIPTION OF THE PREFERRED EMBODIMENTS

The present invention proceeds from the general inventive idea consisting in providing a timepiece of the wristwatch type with a winding and time-setting device that is accessible from the top face of the watch, such that the person wearing such a watch does not have to remove it from his wrist in order to carry out the desired adjustments. Moreover, the device according to the invention takes up very little space, which means it is particularly intended for date watches including a date disc. Indeed, because of the space left free by the device according to the invention, the date disc can be of large dimensions, which means that larger and thus more easily legible numbers indicating the day of the month can be affixed to the disc.

The present invention will be described with reference to a date watch including a date disc. It goes without saying, of course, that this example is given purely by way of illustration, and that the device according to the invention can be applied to any type of wristwatch.

Figure 1:
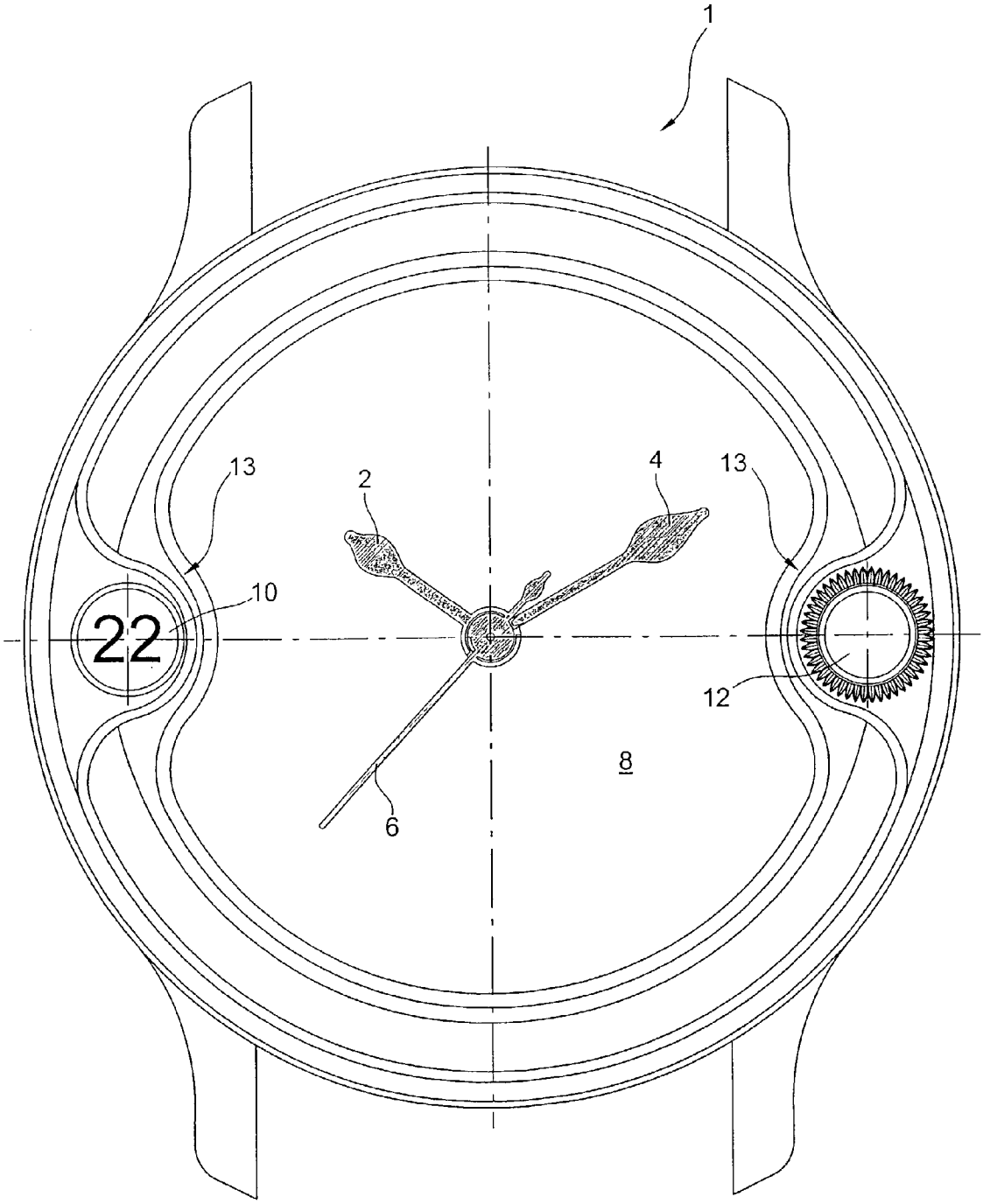
FIG. 1 is a top view showing the general appearance of the timepiece according to the invention in which it can be seen that the aperture pierced in the watch dial and through which the number indicating the day of the month is visible, and the winding and time-setting crown are arranged diametrically opposite each other on the external periphery of said watch, respectively at nine o'clock and three o'clock.

FIG. 1 shows a top view of a timepiece according to the invention. Designated as a whole by the reference numeral 1, this timepiece includes hands indicating the hour 2, minutes 4 and seconds 6. Hands 2, 4 and 6 move above a dial 8 in which an aperture 10 is pierced, through which a number indicating the date appears.

As is visible in FIG. 1, aperture 10 and a fluted crown 12 of the winding and time-setting device according to the invention are arranged diametrically opposite each other, respectively at nine o'clock and three o'clock, on the external periphery of watch 1. "Diametrically opposite" means that the centre of crown 12 and that of aperture 10 are aligned along the same straight line and are arranged at equal distances from the centre of watch 1, represented by the shafts carrying indicating hands 2, 4 and 6. This arrangement wherein aperture 10 matches crown 12 gives watch 1 a new and attractive appearance. Of course, aperture 10 and crown 12 could be arranged in another location relative to the periphery of watch 1, for example at midday and six o'clock respectively. Again in FIG. 1, it can be seen that two indentations 13 are arranged at the periphery of watch 1 to free the necessary space for arranging crown 12 and aperture 10.

Figure 2:
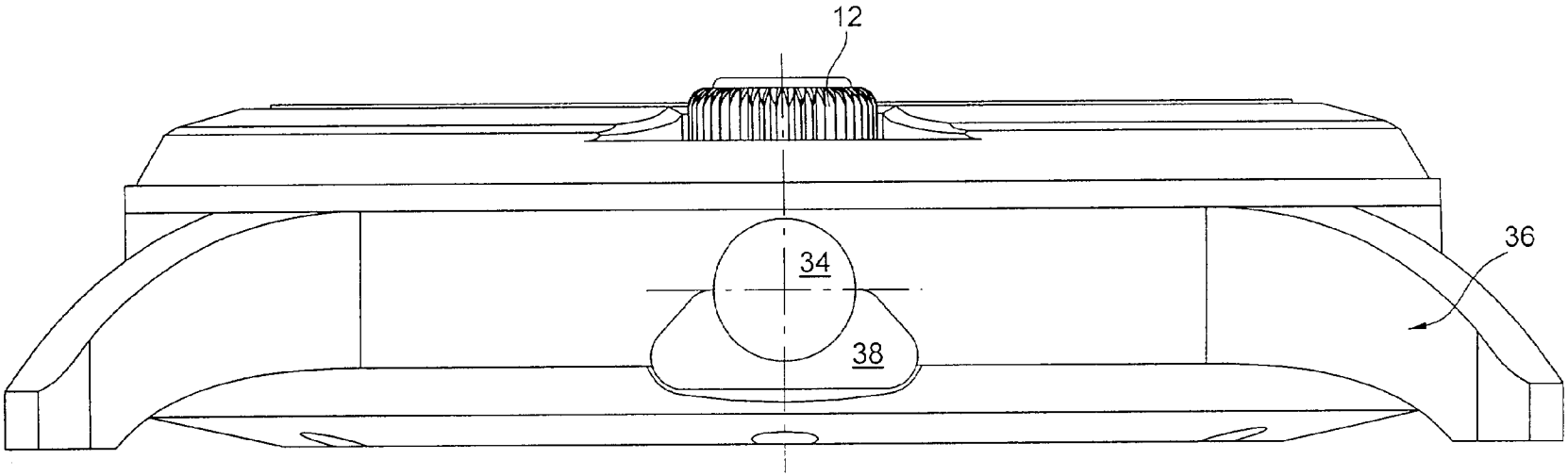
FIG. 2 is an elevation of the timepiece of FIG. 1, said timepiece being shown on the side where the crown is located.
Figure 3:
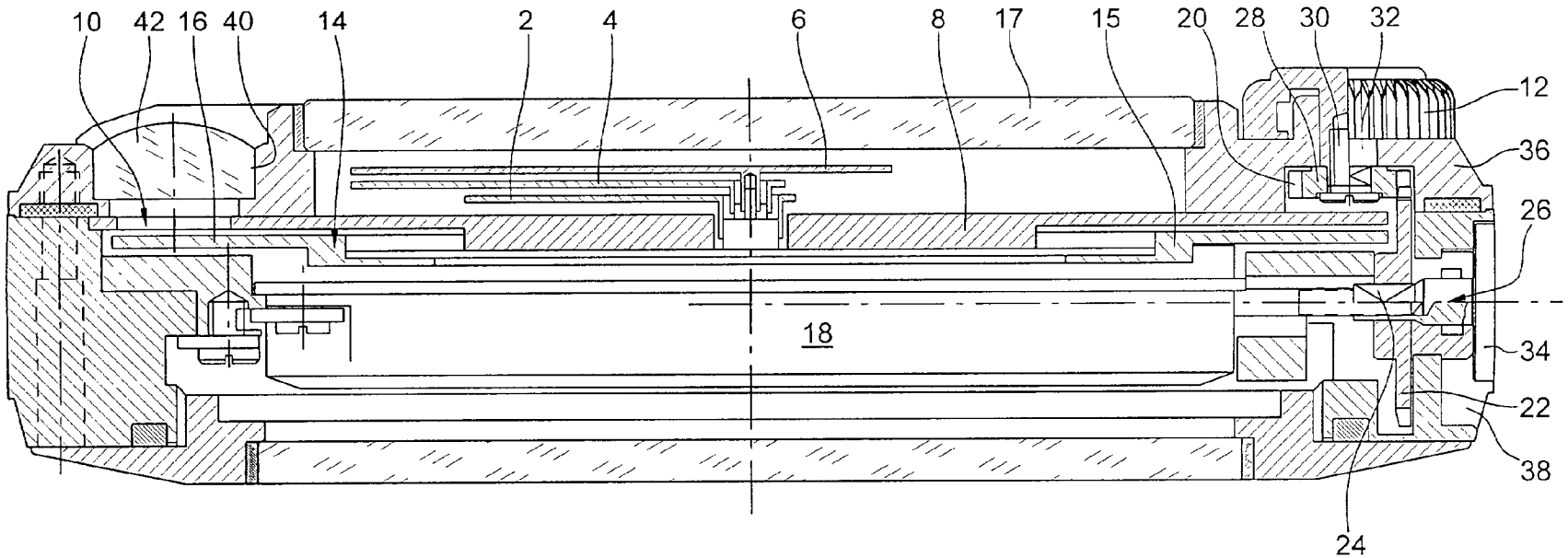
FIG. 3 is a cross-section along the three o'clock-nine o'clock axis of the timepiece shown in FIG. 1.

With reference now to FIGS. 2 and 3, it can be seen that the numbers indicating the day of the month are carried by a date disc 14 which moves below dial 8 of watch 1. This date disc 14 is formed by a ring with an inner toothing 15 and whose external diameter is, in accordance with a feature of the invention, substantially equal to the diameter of watch 1. More precisely, date ring 14 has a tiered structure with a crown-shaped display portion 16 offset towards the periphery of watch 1 and extending underneath winding and time-setting crown 12. The diameter, and thus the perimeter of date disc 14, are limited practically only by the external dimensions of watch 1, which means that larger sized and thus more easily legible figures can be affixed to disc 14. This particularly advantageous result is due to the fact that the winding and time-setting device according to the invention of which crown 12 forms part, occupies very little space. Indeed, crown 12 only partially encroaches on the periphery of watch 1, such that the size of crystal 17 and dial 8 do not have to be reduced to free the space necessary in order to mount, for example, a rotating bezel as was the case in the prior art.

Another advantage of the invention can be seen in the fact that, since large sized figures can be affixed to date disc 14, it is not necessary to provide, for example, two concentric rings, one of which would carry the units of the day of the month, and the other the tens of said date, in order to make the indications more visible. The present invention thus provides a simpler and consequently more reliable and cheaper date mechanism.

Date disc 14 is driven in rotation in an appropriate manner by movement 18 of watch 1. The date disc drive mechanism will not be described here insofar as it does not form the subject of the present patent application. Moreover, those skilled in the art have all the teaching necessary to manufacture such a mechanism.

As appears clearly in FIG. 2, crown 12 is arranged in the top horizontal plane of watch 1 parallel to the plane of movement 18. It is thus easily accessible and can be actuated by the user without the latter having to remove watch 1 from his wrist. This crown 12 has a contrate toothing 20 which co-operates with a wheel 22 mounted via a square portion 24 on a control stem 26 that can move axially mobile. Wheel 22 is permanently meshed with square portion 24.

According to a first variant that is not shown in the drawing, contrate toothing 20 is integral with fluted crown 12. According to a second variant visible in FIG. 3, a toothed wheel 28 is mounted, for example by means of a screw 30, on a central shaft 32 of crown 12 which extends perpendicularly to the plane of movement 18. Of course, wheels 28 and 22 are arranged perpendicularly to each other so as to be able to mesh.

As was mentioned hereinbefore, control stem 26 is axially mobile for example between three distinct positions. In a first position which is that shown in FIG. 3, head 34 of said control stem 26 is sunk in the middle part of watch 1. Rotational movement of crown 12 then causes the simultaneous rotation of control stem 26 which will, for example, by means of a set of wheels and pinions not shown in the drawing, wind the watch movement of watch 1. In a second pulled out position of control stem 26, rotation of stem 26, caused by actuating fluted crown 12, will allow, for example, the user to set the time displayed by watch 1. Finally, when it is in a third pulled out position, control stem 26 can, again by way of example, allow the date display to be adjusted. It goes without saying that the examples given hereinbefore are given solely by way of illustration, and that one may envisage adjusting any other type of function by means of control stem 26.

Of course, whatever the position occupied by control stem 26, the latter is still linked to crown 12 via its toothed wheel 22 which co-operates with toothed wheel 28 of said crown 12. This is made possible due to the fact that wheel 22 is immobilised axially and mounted via a square portion 24 on control stem 26, which allows the latter to slide through said square portion 24.

It will be noted that a recess 38 has been made in middle part 36 of watch 1 in the vicinity of head 34 of control stem 26, in order to allow the user to slide a nail into this recess 38 and to be able to pull out said control stem 26 without any difficulty. Moreover, a through hole 40 is pierced in middle part 36 facing aperture 10 through which the numbers indicating the date appear. The shape and size of this hole 40 is adapted to receive a lens 42 acting as a magnifying glass and providing an enlarged image of the number indicating the day of the month to make the number even more legible. Further, as can been seen upon examining FIG. 3, the top of crown 12, crystal 17 and lens 42 mentioned hereinbefore are in substantially the same plane, such that watch 1 has a top surface free of any roughness on which a shirt or jacket sleeve could become caught.

It goes without saying that the present invention is not limited to the embodiment that has just been described, and that various simple modifications and variants can be envisaged without departing from the scope of the present invention.

What is claimed is:

1. A device for winding and setting the time of a timepiece including a date disc, wherein the device includes a crown arranged in the top plane of the timepiece parallel to a plane of a movement, the crown co-operating with a control stem that is axially mobile in the plane of the movement.

2. The device according to claim 1, wherein the crown has a contrate toothing which co-operates with a first toothed wheel mounted on the control stem.

3. The device according to claim 2, wherein the contrate toothing is integral with the crown.

4. The device according to claim 2, wherein second toothed wheel is mounted on a shaft of the crown that extends perpendicularly to the plane of the movement.

5. The device according to claim 2, wherein the first toothed wheel is mounted via a square portion on the control stem.

6. The device according to claim 3, wherein the first toothed wheel is mounted via a square portion on the control stem.

7. The device according to claim 4, wherein the first toothed wheel is mounted via a square portion on the control stem.

8. The device according to claim 1, wherein the date disc is formed by a ring with an inner toothing whose external diameter is substantially equal to that of the watchcase.

9. The device according to claim 1, wherein the watch includes a dial in which an aperture is pierced through which a number indicating the date appears, the aperture and the crown being disposed diametrically opposite each other on the periphery of the watch.

* * * * *